United States Patent [19]

Naum

[11] Patent Number: 4,958,109

[45] Date of Patent: Sep. 18, 1990

[54] SOLID STATE IGNITOR

[76] Inventor: Daniel Naum, 2048 Midvale Dr., San Diego, Calif. 92105

[21] Appl. No.: 247,727

[22] Filed: Sep. 22, 1988

[51] Int. Cl.[5] ..... H05B 41/36

[52] U.S. Cl. ..... 315/307; 315/220; 315/279; 315/287; 315/290; 315/DIG. 7

[58] Field of Search ..... 315/206, 219, 220, 277, 315/279, 287, 289, 290, 307, 310, DIG. 7

[56] References Cited

U.S. PATENT DOCUMENTS 4,663,570 5/1987 Luchaco et al. ..... 315/219

4,686,428 8/1987 Kuhnel et al. ..... 315/291 X

*Primary Examiner*—David Mis

[57] ABSTRACT

The ignitor is a high voltage power supply for intermittent operation used to ignite HMI (Hydrargyrum Medium Arc Iodide), Xenon and mercury arc lamps of the type typically used in motion pictures, video applications, theater and television. The ignitor inputs through a rectifier circuit and the rectified current drives the primary coil of the first transformer of two ganged transformers. The primary coil is driven into saturation, at which point a pulse-width modulated controller senses that the saturation current has been reached in the primary, and opens a FET which acts as a switch in series with the primary, collapsing the field around the primary to induce an energy surge into the secondary, which results, after further conditioning and transforming, in the production of a high voltage (30 kv–50 kv) arc-jumping current to ignite the arc lamp to which it is connected.

10 Claims, 2 Drawing Sheets

PRIOR ART IGNITOR

SOLID STATE IGNITOR

BACKGROUND OF THE INVENTION

Arc lamps, such as HMI (Hydrargyrum Medium arc Iodie), Xenon, and mercury arc lamps, require a high voltage discharge to ionize, and sometimes vaporize, the illuminating medium inside the discharge tube.

Traditionally, this arc-starting power has been provided by a very straightforward, if not optimum, circuit comprised of two ganged transformers, the primary of the second transformer (and the secondary of the first transformer) being in series with a spark gap which alternately makes and breaks the circuit as the voltage level rises and falls to create current spikes that cause high voltage in the secondary of the second transformer, which is directly connected to the electrodes inside the arc lamp.

Obviously this system is functional in that it does ignite the arc lamps. It is one of the first systems that an engineer charged with creating an ignitor would conceive of, and has probably been used in the same substantially unchanged form for decades. Very likely the circuit has been used continuously without substantial modification since well before the advent of solid state devices.

As solid state electronics engineering has progressed in sophistication, a circuit which might have been close to optimal according to yesterday's technology becomes subject to improvement by incorporation of the technology of today.

Specifically, although the original ignitor does indeed work, when viewed from the perspective of solid state technology and integrated circuit thinking, it is a heavy-handed approach to the problem and is somewhat inefficient in its operation by virtue of producing unregulated current which is more than is necessary for the job throughout much of its cycle. It also requires an AC source, and materials, such as the transformers, that are three times the weight and twice the size of a more sophisticated unit optimizing the characteristics of weight, size, and efficiency by the use of state-of-the-art electronics.

SUMMARY OF THE INVENTION

The instant invention is such a state-of-the-art electronic device which is in fact approximately one third of the weight, and half of the size of the existing prior art ignitor.

As does the prior art, the invention utilizes first and second stage transformers and second stage circuitry connecting the secondary of the first stage transformer and the primary of the second stage transformer.

The circuitry of the first part of the circuit, which includes the primary of the first stage transformer, utilizes a diode bridge rectifier so that any kind of power of suitably high voltage can be used to power the system. AC, DC, or pulsating DC of about 220 volts can be used to power the unit, so that it can be battery operated or powered on-line from a 220 volt, 60 cycle AC outlet.

The rectified current from the rectifier passes through the primary of the first stage transformer, and then through an FET which acts as a control switch to instantaneously stop the current through the primary.

The FET is controlled by a UC1844U pulse width modulated, current-sensing controller. This controller senses the current through the primary as it drops across a resistor in series with the primary and the FET, and the system is tuned and adjusted so that when the current through the primary reaches saturation current, it triggers the controller to output a (low state) voltage which turns the FET off, stopping the current through the primary and collapsing its field, inducing a high voltage in the secondary. The coordinated selection of the parts, and the choice of the external capacitor and resistor for the oscillator enables the system to work effectively at about a 10% duty cycle as the unit pulses at about 40 khz for one to two seconds.

BRIEF DESCRIPTION OF THE DRAWINGS

FIG. 3 is a pin-out diagram of the controller IC; a

DETAILED DESCRIPTION OF THE PREFERRED EMBODIMENT

Figure 2:
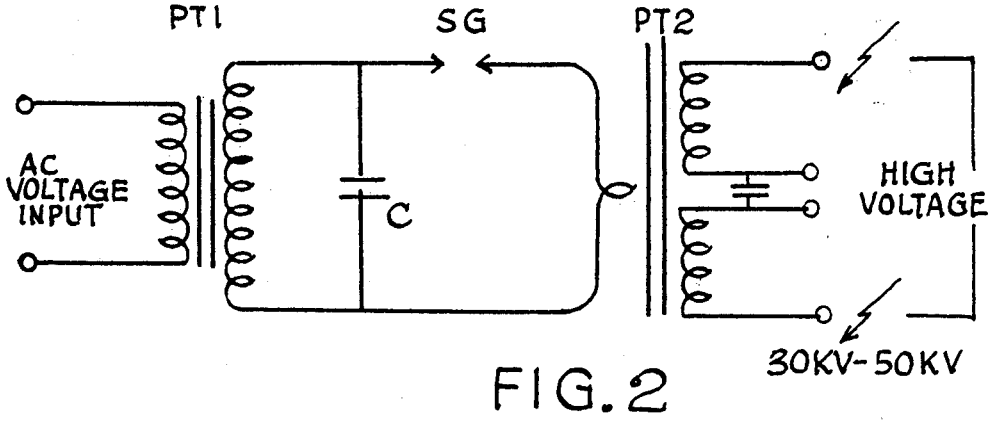
FIG. 2 is a schematic of the prior art ignitor.
Figure 3:
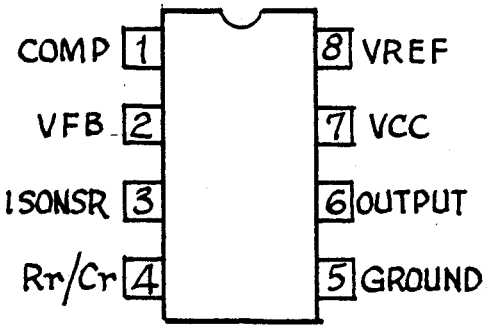

The simple prior art system is illustrated in FIG. 2. An AC voltage input to the primary of the transformer PT1 produces 5kv–8kv in the secondary, causing current to flow in the primary of PT2 except when spark gap SG opens at the lower level of the voltage cycle. The spark gap causes a crisper current interruption and a higher voltage in the secondary of PT2, which produces the alternating current voltage, reaching the 40,000 volts or so necessary to start the arc in the arc lamp.

FIG. 2 illustrates a system that is workable, but is not fine-tuned, with neither the current nor the voltage being regulated with any accuracy. The time at which the spark gap opens may not synchronize very well with the time at which the current in the primary PT2 reaches saturation. Additionally, the output voltage may fluctuate between 30 Kv and 50 Kv as the input varies from 180 volts to 240 volts.

Figure 1:
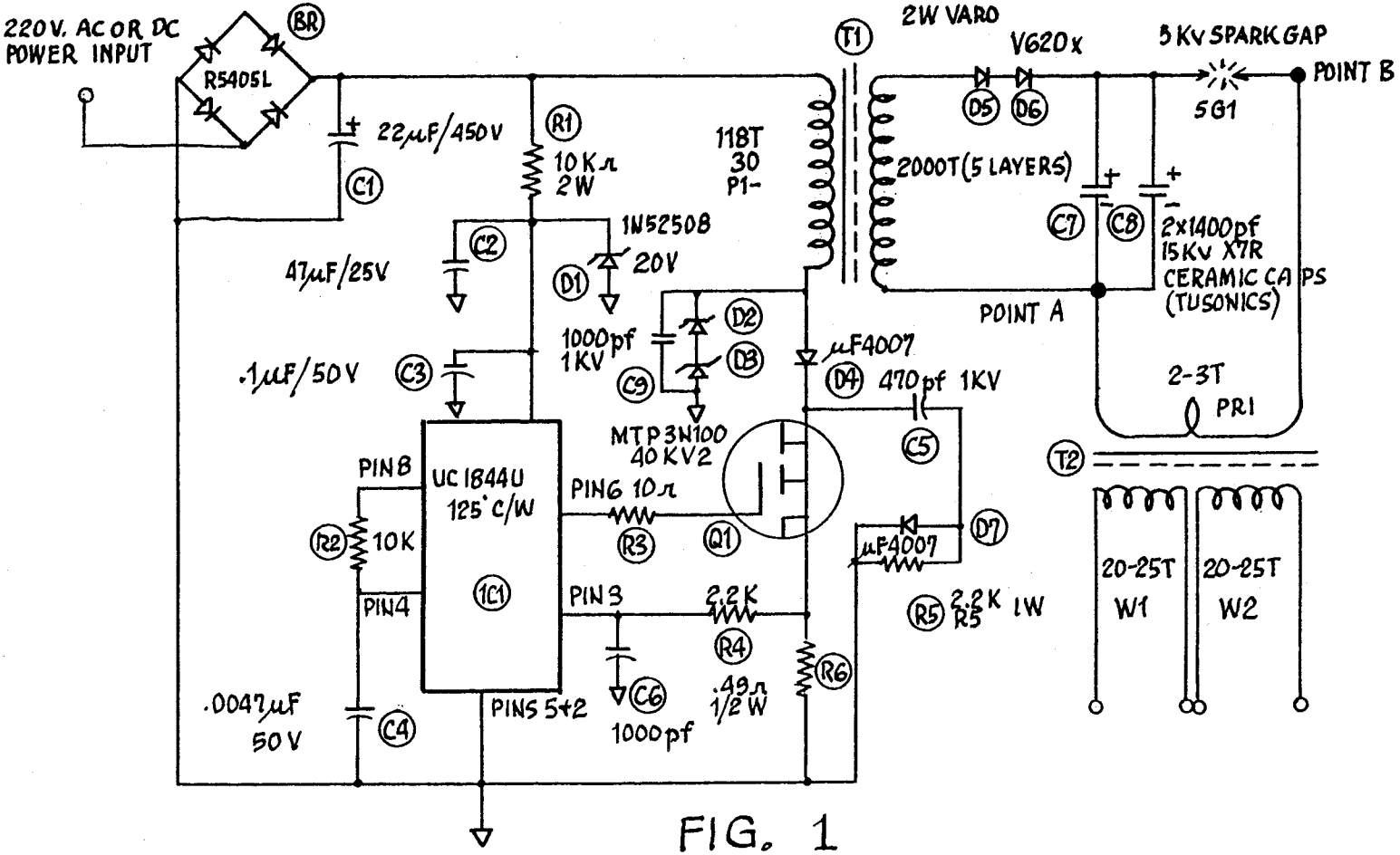
FIG. 1 is a schematic of the circuit with the component values listed beneath.

The instant invention is illustrated in the remaining figures. It produces a relatively constant output voltage irrespective of fluctuations in the input voltage at the power supply. FIG. 1 illustrates the circuit, with the component values being listed in the schematic, and below the figure as well for even further specificity and clarity.

Power input to the device occurs at the upper left corner of the figure, into the bridge rectifier BR which is capable of operating on input voltages of up to 370 volts, AC or DC. Capacitor C1 smooths the voltage waveforms somewhat, and the voltage powers the primary coil P1 of transformer T1, as well as the controller IC1 which is preferably one of the UC 1842/3/4/5 family of control IC's. Voltage to the controller is dropped by resistor R1, capped at 20 volts for protection against voltage overload by Zener diode D1, and is conditioned to remove low and high frequency irregularities by capacitors C2 and C3. IC1 can take up to 30 volts and the possibility of voltage overload resulting from high-voltage spikes in its power supply, so it has a ten volt margin.

The current from the rectifier which passes through primary P1, passes through a subsequent rectifying diode D4 and down to the switching device 12, which in the illustrated embodiment is a field effect transistor, MTP 3N100, indicated at Q1. The current subsequently passes through resistor R6 to ground. Resistor R6, with the very low resistance of 0.49 ohms provides a convenient take-off point for the input at pin 3 of IC1. This is the "current sensing" input and the voltage dropping resistor may range from 0.4 ohms to 0.6 ohms. The controller IC1 outputs at pin 6, and resistor R6 and the other trimming circuitry in that region of the circuit are designed to produce a voltage at pin 3 equal to about 1 volt when the current through the primary P1 reaches the saturation current. Controller IC1 ordinarily outputs a positive signal of about 12 volts at pin 6 during the "on" portion of the oscillator cycle, which turns on the FET Q1. When 1 volt is sensed at pin 3, pin 6 goes low and turns off Q1.

The controller produces an output at pin 6 which is a pulse having a frequency generated by an internal oscillator equal to 1.72/(R)(C), where R and C are equal to the values of external timing resistor and capacitor R2 and C4. Thus, in the illustrated embodiment R2=10 K-ohms, C4=0.0047 Microfarads, and, the pulse frequency at pin 6 is 36.6 khz. The controller is pulse-modulated, so that the frequency remains stable at 36.6 khz, but the pulse width is determined by the timing of the voltage rise at pin 3.

Figure 5:
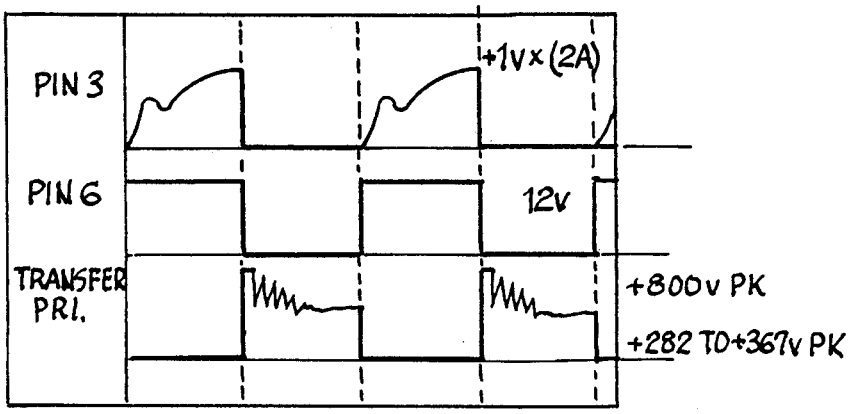
FIG. 5 graphs the voltage at pins 3 and 6 and across primary P1 throughout the pulse cycle.

FIG. 5 illustrates the voltage across pin 3, pin 6, and primary T1. The scales are different for each waveform, with the approximate maximum voltage indicated toward the right of each waveform. These tracings reveal that as the current rises through the primary P1 and the commensurate voltage rise is occuring at pin 3, the primary P1 is essentially a short circuit. As the current begins to level off as indicated at pin 3, the pin 3 voltage reaches the Q1 triggering level, shutting off the pin 6 output from Q1, and causing the sudden collapse of the magnetic field around the primary and the induced voltage shown in the Pl voltage waveform diagram.

The pulse is actually triggered when the voltage at pin 3 reaches 1 volt. At this point, pin 6 drops to 0 volts, shutting FET Q1 off. Q1 will remain latched off until the internal oscillator of IC1 initiates a new pulse, turning on Q1 to permit current through primary coil P1 until again, the coil becomes saturated and the IC is caused to output zero volts to pin 6. The components are tuned such that Q1 is on only about 10% of the time.

Zener diodes D2 and D3 protect Q1 from voltage spikes above 400 volts, with the help of C9. Other resistors, capacitors and diodes have various trimming and smoothing functions, and will not be discussed in detail.

The transformers use light-weight ferrite cores, which are highly efficient at the operating frequencies of the ignitor. Because ferrite cores can be used because of the relatively high operating frequency, the transformers used in the ignitor only weigh about half a pound each, as opposed to the three or four pounds that the transformers in the prior art ignitors weigh.

Figure 4:
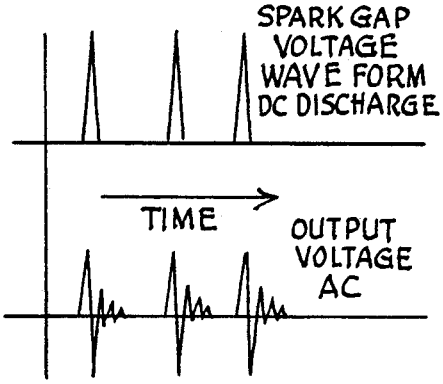
FIG. 4 graphs the spark gap voltage and the output voltage over time.

Thus, a second stage of transformer T1 is induced with a high voltage alternating current on the order of 5,000 to 10,000 volts. This current is rectified by D5 and D6, and the rectified current charges capacitors C7 and C8 until the spark gap SG1, which has a 5kv–9kv threshold, discharges, dropping the voltage across the gap essentially to zero, as shown in the top graph of FIG. 4. This sharp rise and fall in the voltage, and the corresponding current surges in the SG1 circuit produce a rapidly rising and falling flux in transformer T2, on the order of 40,000 volts or more, in windings Wl and W2 of the secondary of transformer T2. These windings are ordinarily wired in series, and include the arc lamp, and also include the steady power supply voltage that is applied to the lamp for steady illumination after the ignitor has finished igniting the lamp.

Because of the much more carefully controlled sequencing of events in the ignitor, maximum spark is achieved by terminating the current through primary P1 at maximum flux density, and the short, 10% duty cycle enables the transformers to be somewhat smaller in size and dissipate less heat than the conventional, prior art system. The result, as indicated above, is a system which weighs only about a third of what the prior art ignitor weighs, and takes up only half the volume, and accomplishes the igniting function much more efficiently.

I claim:

1. An ignitor circuit for producing a high-voltage arc current for igniting an arc lamp or the like comprising:
   (a) a DC power source;
   (b) a flyback transformer having a primary coil and a flux-coupled secondary coil;
   (c) a switching device in series with said primary coil and said power source such that the opening of said switching device interrupts the current in said primary coil;
   (d) a solid state current-sensing controller operatively connected to said primary coil and having an oscillator which produces a periodic output voltage to said switching device to open same upon said controller sensing current in said primary coil substantially equal to the saturation current therein; and,
   (e) a second-stage circuit connected to said secondary coil for conditioning the power induced in said secondary coil to produce a high voltage arc-crossing current to ignite an arc lamp.

2. Structure according to claim 1 wherein said controller is a pulse width modulation controller.

3. Structure according to claim 2 wherein the output voltage of said controller comprises a periodic pulse which closes and holds closed said switching device and senses current as analogue voltage dropped across a resistance in series with said primary coil, and when said analogue voltage rises to a level substantially analogous to saturation current flowing through said primary coil, the output voltage from said controller reverses state, opening said switching device and thus terminating current in said primary coil.

4. Structure according to claim 3 wherein said controller is one of a group of UC 1842/3/4/5 family of control IC's.

5. Structure according to claim 4 wherein said switching device is an FET.

6. Structure according to claim 5 wherein said FET is specifically a MTP 3N100.

7. Structure according to claim 4 wherein said controller has an internal oscillator section tuned with an external resistor and capacitor, and said external resistor and capacitor are on the order of 10 k-ohms and 0.0047 microfarads, to create an oscillation frequency on the order of 40 khz.

8. Structure according to claim 1 wherein said DC power source comprises a high voltage bridge rectifier capable of operating on the order of 370 DC or AC volts input.

9. Structure according to claim 8 wherein said solid state controller is powered by said rectifier and protected from voltage overload by a grounded Zener diode and a capacitor.

10. Structure according to claim 1 wherein said second stage includes a circuit loop provided with at least one rectifier diode, which circuit loop splits into a first capacitor branch and a second branch including a spark gap and the primary coil of a second transformer, and the secondary coil of said secondary transformer outputs the arc-jumping voltage produced by said ignitor circuit.

* * * * *